US008874026B2

(12) United States Patent
Anstandig et al.

(10) Patent No.: US 8,874,026 B2
(45) Date of Patent: Oct. 28, 2014

(54) SYSTEM FOR PROVIDING AUDIENCE INTERACTION WITH RADIO PROGRAMMING

(75) Inventors: Daniel Anstandig, Bay Village, OH (US); Brian Seeders, Westlake, OH (US)

(73) Assignee: Listener Driven Radio LLC, Rocky River, OH (US)

( * ) Notice: Subject to any disclaimer, the term of this patent is extended or adjusted under 35 U.S.C. 154(b) by 276 days.

(21) Appl. No.: 13/409,725

(22) Filed: Mar. 1, 2012

(65) Prior Publication Data

US 2012/0302156 A1 Nov. 29, 2012

Related U.S. Application Data

(60) Provisional application No. 61/519,505, filed on May 24, 2011.

(51) Int. Cl.
*H04H 60/29* (2008.01)
*H04H 60/33* (2008.01)
*H04H 60/06* (2008.01)

(52) U.S. Cl.
CPC ..... *H04H 60/06* (2013.01); *H04H 2201/33* (2013.01)
USPC ..... 455/2.01; 455/3.03; 455/419; 455/3.01

(58) Field of Classification Search
CPC ..... H04H 60/33; H04H 60/46
USPC ..... 455/2.01, 3.01, 3.03, 419, 452.1, 509, 455/420, 418, 67.11, 458; 707/10, 102, 707/104.1; 709/204
See application file for complete search history.

(56) References Cited

U.S. PATENT DOCUMENTS

| | | | | |
|---|---|---|---|---|
| 7,076,202 | B1 | 7/2006 | Billmaier | |
| 7,698,723 | B2 | 4/2010 | Hicks, III et al. | |
| 8,392,206 | B2 | 3/2013 | Parekh et al. | |
| 2006/0184977 | A1 | 8/2006 | Mueller et al. | |
| 2006/0288074 | A1 | 12/2006 | Rosenberg | |
| 2008/0146342 | A1 | 6/2008 | Harvey et al. | |
| 2009/0063511 | A1 * | 3/2009 | Myers et al. | 707/10 |
| 2009/0157731 | A1 * | 6/2009 | Zigler et al. | 707/102 |
| 2011/0067044 | A1 * | 3/2011 | Albo | 725/13 |

OTHER PUBLICATIONS

International Search Report and Written Opinion of the International Searching Authority; International application No. PCT/US12/39095; International filing date May 23, 2012; Applicant: Listener Driven Radio LLC.

* cited by examiner

*Primary Examiner* — John J Lee
(74) *Attorney, Agent, or Firm* — Hudak, Shunk & Farine Co. LPA

(57) ABSTRACT

A system of capturing real-time audience interaction via a web-based user interface and automatically adjusting a radio station's programming through a unique direct interface with the radio station's studio operating system and/or music scheduling system. The web based user interface is accessible through a computer, mobile, cellular, and social media site or web-connected car dashboard. Audience participation is collected and processed using an algorithm to determine how a radio station's programming should be manipulated to fit the preferences of the audience. The invention allows the audience to determine which selection should play next on the air, prioritize which elements should play on the air, to play audio on demand, and to upload audio selections, and provides instant alerts, such as by SMS texting, IM, E-mail, and Social Media when a listener's selection is about to play on the air.

22 Claims, 3 Drawing Sheets

| | | | | |
|---|---|---|---|---|
| 04 | 550435 | TOP OF HOUR | | 2 02 27 12 05 |
| 03 | 703551 | IN THE AIR TONIGHT | 285 | 2 02 27 12 05 |
| 20 | 2 | UpickStart | | 2 02 27 12 05 |
| 03 | 703071 | REAL WORLD | 229 | 2 02 27 12 05 |
| 04 | 550380 | Quickies / Logos | | 2 02 27 12 05 |
| 03 | 22985 | BABY HOLD ON | 182 | 2 02 27 12 05 |
| 04 | 550615 | LDR INTO STOPSET | | 2 02 27 12 05 |
| 04 | 550445 | TRAFFIC INTRO W/ VOICE | | 2 02 27 12 05 |
| 04 | 550010 | MORNING TRAFFIC LAKE SPE | | 2 02 27 12 05 |
| 08 | SPOTS4 | SPOTBLOCK | | 2 02 27 12 05 |
| 04 | 550326 | WX INTRO / CANLEY INCLUD | | 2 02 27 12 05 |
| 04 | 89069 | PM WEATHER | | 2 02 27 12 05 |
| 04 | 550630 | LDR out of stopset | | 2 02 27 12 05 |
| 09 | 4 | LDR Vote Options End | | 2 02 27 12 05 |
| 03 | 26647 | HUMAN | 225 | 2 02 27 12 05 |
| 03 | 26736 | STONE IN LOVE | 263 | 2 02 27 12 05 |
| 03 | 27824 | HOT IN THE CITY | 206 | 2 02 27 12 05 |
| 09 | 3 | LDR Vote Options Start | | 2 02 27 12 05 |

Figure 2

LDR.1

LDR.Takover

SYSTEM FOR PROVIDING AUDIENCE INTERACTION WITH RADIO PROGRAMMING

CROSS REFERENCE

This Application claims the benefit of priority under 35 U.S.C. §119 of U.S. Provisional Application Ser. No. 61/519,505, filed on May 24, 2011, herein fully incorporated by reference

FIELD OF THE INVENTION

The present invention relates to a system for providing audience interaction with broadcast programming, and specifically radio programming; and to influence the selection of broadcast content with the option of providing real-time selection of broadcast content or to provide content to be scheduled at a later time. The invention uniquely interfaces directly with a broadcast station's studio operating system, manipulating the on-air content schedule based on audience interaction through various electronic devices, such as a computer or mobile device or internet enabled car dashboard.

BACKGROUND OF THE INVENTION

The nature of the broadcast radio competitive landscape has changed significantly over the past decade. New various electronic devices, such as mp3 players, have provided a greater number of options for music and spoken word consumers to enjoy audio content. Whereas 50 years ago, over the airwaves radio was the primary source of audio entertainment and a "radio" was the only means of listening to radio broadcasts, a multitude of receiver options are presently available to audio listeners. Moreover, CD and MP3 players, as well as the internet, have given listeners the ability to choose audio content for themselves, leaving broadcast radio working hard to attract and maintain its audience.

In the past, broadcast radio has instituted methods to allow audience to participate in content selection, including phone lines and listener surveys. These have helped some radio stations develop or maintain listener loyalty and to maintain market share. However, they have always required a "curator," such as a Disc Jockey or Program Director to adjust the radio station's programming using the information collected from said surveys and "phone call-ins." Neither has there been a standard for aggregating this audience data.

The present invention provides a system in which the audience's votes and participation can automatically (i.e., without the need for a person to participate by using a set of rules) manipulate a radio station's music schedule or spoken word programming schedule by interfacing with the radio station's studio operating system and/or programming scheduling software. In particular, this system provides a choice of a given number of selections, and allows audience members to vote on which selection they prefer to hear. The most popular selection is then routed directly into the radio station's playlist (which resides in the radio station's music scheduling software or studio operating system) as the next play. Additionally, the system can gather "soft", or more passive data, including, for example, information about whether a listener turns the volume up, or switches stations. The present invention also includes a user interface in which a curator, such as a DJ, can review live voting results.

Members of the audience can be prompted to participate in a vote by alerts, delivered by SMS, IM, or e-mail or by social media including for example FaceBook® and Twitter®. The audience can use various devices to input their vote, such as a computer, work station, PDA, cellular device, cable box, mobile pad, game station, or vehicle infotainment system. In a further embodiment of the invention, members of the audience can upload audio files, which may then be moderated or screened by the radio station staff. Then, those audio files may be available for other listeners to play on demand or stream to their device.

SUMMARY OF THE INVENTION

The present invention provides an audience interaction system for broadcast programming, which gathers audience input including, for example, votes via an interactive interface accessible through the communication network, which includes various electronic communication methods, such as the internet, telephone and cable, and mobile devices, such as cellular, tablet/e-pads, and PDAs. The present invention then regulates by statistically weighting or balancing audience input using an algorithm, and it interfaces with a radio station's studio automation operating system and/or content scheduling software to automatically affect the scheduling of on-air content. As an example, listeners may vote on which selection (and specifically, which song) should play next on a radio station, then the present invention will interface with the radio station's automation system to manipulate which selection should play at a certain time in the programming lineup. The current system may then also receive information back from the radio station studio system, which may be used to schedule or process alerts back to listeners that their selection is about to play on the air.

BRIEF DESCRIPTION OF THE DRAWINGS

FIG. 2 is a representation of the screen which is used to prompt the audience member to participate by triggering the beginning and end of the voting incident.

DETAILED DESCRIPTION OF THE INVENTION

Figure 1:
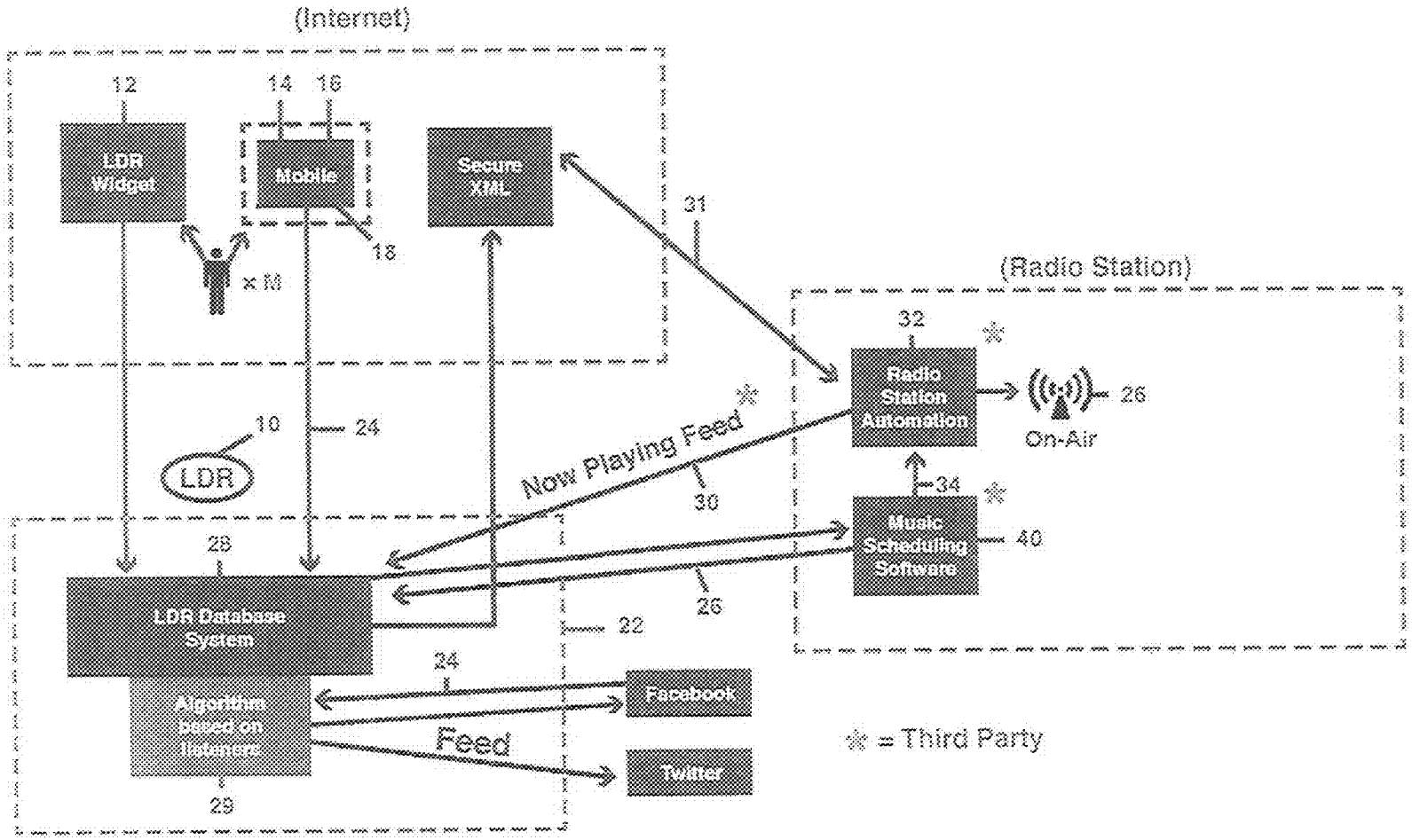
FIG. 1 is diagram of the present invention.

FIG. 1 shows a schematic view of the audience interaction system in accordance with the present invention. The system shown generally 10 involves an audience interaction user interface or "widget" (which may vary in its appearance) 12 which gathers data from the audience members by means of an input device 14, which could include a mobile device 16 (including specifically but is not limited to a phone or other a cellular device, a pda, an e-pad, a vehicle infotainment system or a lap-top computer in wireless communication such as by means of the internet). The input device could also include stationary devices 18 such as a home computer, a work station, a cable box and a game station. The data is gathered from the mobile or stationary device using the audience interaction user interface or "widget" 12 which is hosted online and may be framed into a radio station website 22 Generally, the data is gathered from the audience members by voting on a selection 24 (including but not limited to audio selections such as songs, news stories, sports information, children's stories, instructions, recipes, and work-out scripts to name a few) or video selections (including but not limited to music videos, news stories, sports information, children's programs, health and fitness videos, and recipes). The audience is asked to select one of the choices for broadcast 26 or prioritize which audio selection should play next out of a list of upcoming selections.

The invention uses a software program 28, to gather the "Now Playing" or "Currently Playing" selection data 30 from an automation/play-out system at a radio station 32 and to capture the command-cue to begin and end a voting session for the audience interactive "you pick the next song" feature. The audience interaction user interface or "widget" 12 displays information regarding the selection currently being played, for example the title and artist of the song currently playing on the air. Optionally, the widget can display past or future broadcast information, as well as information as to when the next voting session will occur, or information as to results from current or past voting sessions, including for example, the winning choice, the percentage of audience voters who voted for that choice, and the number of times that the choice has won over a set period. The audience interaction user interface may also show information about the artist, composer, or creator of the audience selection, including, but not limited to latest news, biographies, discographic information, lyrics, or other relevant information.

Selections can be added to the audience interaction user interface through an admin screen privately accessible by the radio station. The radio station may also upload a list of selections using a comma-delimited text file with a list of selections in a format including artist or performer and title of the selection. This method is preferred for up-loading a larger batch of selections.

The audience can use the audience interaction user interface or "widget" 20 to view a list of selections made available by the broadcaster and can vote to play those selections at a later point or "on-the-air" as directed by the broadcaster. The broadcaster is given the option for incorporating audience interaction through a playlist management system 40 which includes controls for the playlist module 42, controls to activate various settings related to feeding the radio station studio operating system, a screen to add a selection to the playlist, to start a voting session by adding a "pick next" voting session, to view live voting session results by managing and viewing "pick next" voting sessions, and to generate voting result reports.

The audience views the list of selections on the audience interaction user interface ("widget"). The audience can rate and request selections from this screen and receive notifications or alerts such as by e-mail, instant messenger, sms text or social media including Facebook® or Twitter® of when requested selections will play on air. The broadcaster can use the playlist management system to remove a selection from the audience interactive system library including permanently removing the selection from the library.

The broadcaster uses the playlist management system 40 to provide the choice of selections and configure how the audience will be allowed to interact with the playlist selections. The broadcaster may also use their music scheduling software to schedule voting sessions using commands such as "UpickStart," "LDR Vote Options Start," "LDR Vote Options End", "Begin Song Replacement", and "End Song Replacement." These are commands unique to the present invention that can identify specific positions in a schedule where the audience may choose elements (such as songs). When a 30 broadcaster's automation system or audio playback system sends the appropriate command through its now playing data feed, the next voting options are immediately placed on the "You pick the next selection" screen of the audience interaction user interface/widget 20. The management system allows the broadcaster to watch the live voting session or to reload votes to see up-dated results at any time. The vote can be set for a specified length of time, such as by automation, or can be closed manually by signaling the playlist management system to close the voting. The 30 radio station automation system may also connect with a 34 automation command system using an API (application protocol interface), which will supply information on which element is to be played on the air at a specified time.

The playlist management system allows the broadcaster to see the results from audience voting by requesting reports, which can be filtered by set periods of time, including the last 24 hours, the last 7 days or the last 30 days.

The playlist management system includes the ability to vary the amount of in-put that an audience is given, such as by making a selection "requestable" which determines selections that can be requested and voted on, or "UPickable" which determines selections that will be part of the "you pick the next selection" voting. It also uses an algorithm to recommend which songs should be played more or less to the broadcaster, based on audience impact data from voting sessions or request quantities which is determined from audience request tallies.

Depending on the configuration chosen by the broadcaster, the Audience Interaction User Interface 26 may also show a list of elements which have the potential to play in the future, where the audience can register several positive and negative votes for elements by prioritizing which ones should play sooner or later in the schedule.

In order to accommodate input 34 from the automation command system, various commands are scheduled in the radio station's programming logs. Those commands 30 are sent by the radio station automation system to the present invention's automation command system to cue the start and end of voting sessions and features on the audience interactive user interface ("widget.") The automation command system 32 provides information 31 to the radio station automation system as to which selection received the most votes and should be played next on the air. The winning selection will air and the automation system 32 will automatically save the changes to the pre-preprogrammed playlist and will allow for reconciliation of the schedule.

An algorithm 29 is used, so that winners will be selected only if they pass both the unbreakable and breakable rules configured in the playlist management system. The playlist is subsequently reconciled, which should take a minute or two per day's schedule.

The invention further includes a feature which allows the playlist management system to place a song which is "most requested" into the music schedule. Again, the "Most requested" command is placed in a fixed position on the radio station's schedule. Following a command to the playlist management system, it will replace the fixed position with the "Most requested" selections, providing that they pass all of the unbreakable and breakable rules noted in the playlist management system.

An additional aspect of the present invention is that it allows audience members to up-load selections, such as their own songs, which can be up-loaded as an MP3, AC3, Wav, or OGG format file. The selection goes first to the Program Director for approval in the playlist management system. These selections can be viewed on the administrative screen. Following review the songs can be mark approved, disapproved or undecided. They can further be marked approved/streaming enabled and can be placed automatically on the audience interactive user interface for streaming. The radio station may also play the audio on the air along with information such as the selection title and band name, which is preferably provided as metadata when the selection is downloaded.

FIG. 2 illustrates a "UPickStart" screen for "Breaknotes" which can be used to create breaknotes and to help trigger the a voting the beginning and end of a voting incident. The selection choices can be selected by a variety of means, such as by selecting specific songs or using themes by which songs are categorized.

Figure 3:
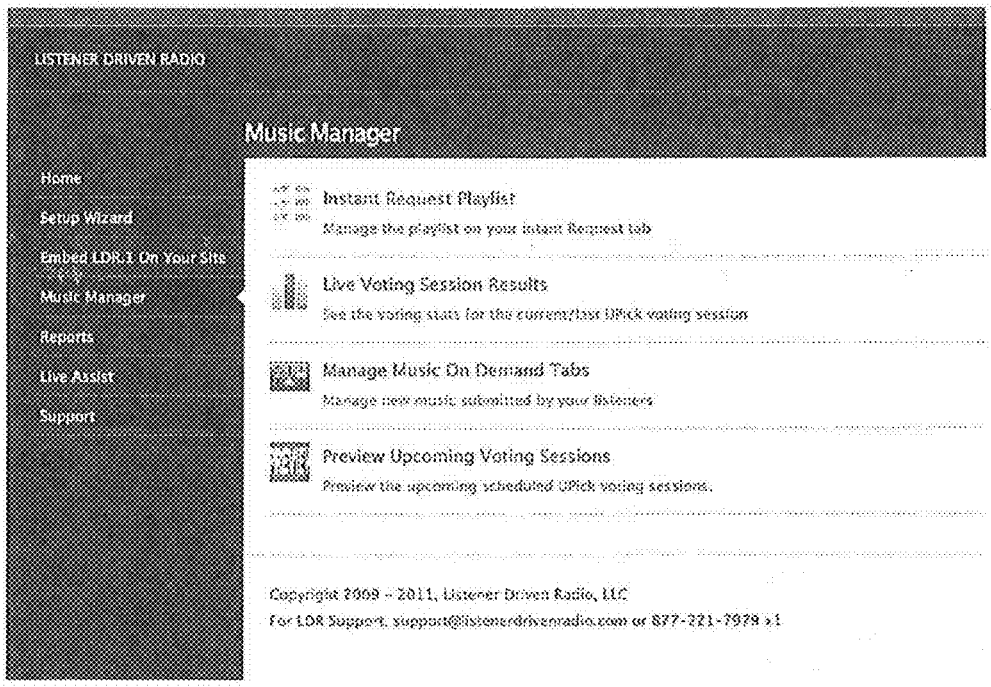
FIG. 3 is a representation of a web-based control screen.
Figure 3:
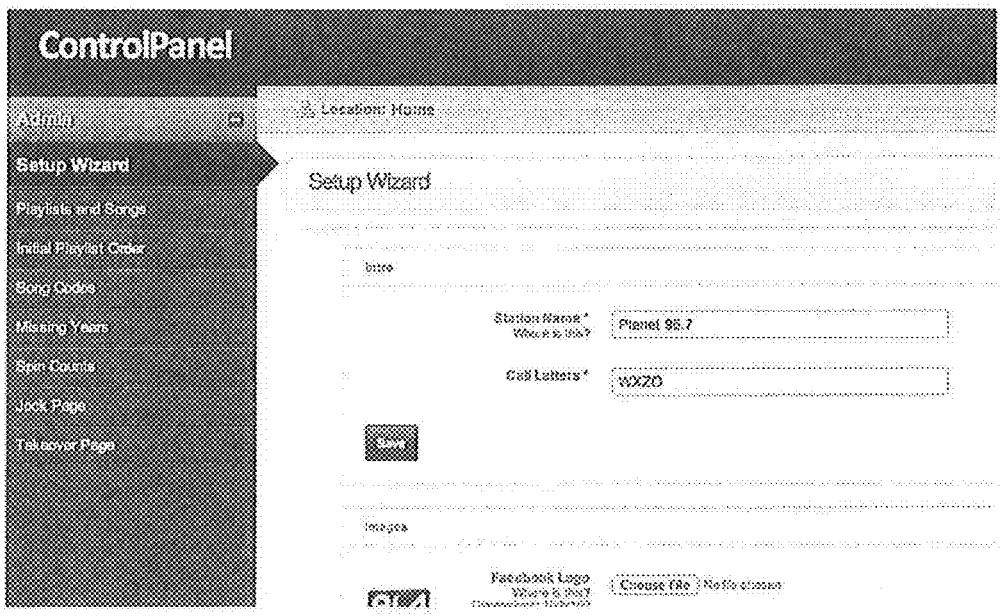

FIG. 3 illustrates the Web-Based Control Screen that helps to generate a "Rate-And Request" song screen that allows the audience to view a list of selections that the radio station has chosen and to vote to play those songs on the air.

While in accordance with the patent statutes the best mode and preferred embodiment have been set forth, the scope of the invention is not limited thereto, but rather by the scope of the attached claims.

What is claimed is:

1. An audience interaction system which interfaces with a radio station scheduling system which includes a radio station automation system and which determines a radio station play schedule comprising means to gather audience selection votes, an audience command system automation to regulate the audience selection votes by cueing the start and end of an audience voting session, and an algorithm which processes the audience selection votes and automatically manipulates the radio station play schedule by communicating with the radio station automation system through a secure means.

2. An audience interaction system as set forth in claim 1 which further includes the option of alerting the audience as to when a selection will be played.

3. An audience interaction system as set forth in claim 2 wherein the alert is supplied by one or more of SMS texting, IM, E-mail, and Social Media, which is cued by the radio station scheduling system.

4. An audience interaction system as set forth in claim 3 wherein the means of gathering the audience votes includes one or more of internet, mobile, cellular, and social media.

5. An audience interaction system as set forth in claim 4 wherein the system allows the audience to determine a next radio selection in real-time.

6. An audience interaction system as set forth in claim 4 wherein the system further allows the audience to play audio on demand through an audience interactive user interface.

7. An audience interaction system as set forth in claim 4 wherein the system further allows the audience to upload audio selections.

8. An audience interaction system as set forth in claim 3 wherein Social Media includes Facebook® or Twitter®.

9. An audience interaction system as set forth in claim 1 with a configurable audience interaction user interface in which the audience may prioritize selections to play sooner or later in the radio station play schedule.

10. A method of providing audience interaction with the play schedule of a radio station which is determined by an automated radio scheduling system comprising the steps of:

a) using an audience automation command system to gather audience input as to a radio selection through the communication network;

b) using the audience automation command system to conduct a voting session initiated by the radio station automation system and to tabulate audience input gathered in the voting session and then to provide information to the automated radio scheduling system; and c) interfacing with the automated radio scheduling system by communicating through the radio automation command system with the audience automation command system automatically affect the scheduling of on-air content.

11. A method of providing audience interaction with the play schedule of a radio station as set forth in claim 10 wherein the communication network includes one or more of the internet, telephone communication, television communication, and radio communication.

12. A method of providing audience interaction with the play schedule of a radio station as set forth in claim 11 wherein the audience input includes votes on a plurality of selections.

13. A method of providing audience interaction with the play schedule of a radio station as set forth in claim 12 further including the step of alerting the audience as to an up-coming voting event.

14. A method of providing audience interaction with the play schedule of a radio station as set forth in claim 13 wherein the step of alerting uses one or more of SMS texting, IM, E-mail, and Social Media, which is cued by the radio station scheduling system.

15. A method of providing audience interaction with the play schedule of a radio station as set forth in claim 10 wherein the audience interaction system allows the audience to determine a next radio selection in real-time.

16. A method of providing audience interaction as set forth in claim 10 with the play schedule of a radio station wherein the audience interaction system further allows the audience to play audio on demand through an audience interactive user interface.

17. A method of providing audience interaction with the play schedule of a radio station as set forth in claim 10 wherein the audience interaction system further allows the audience to upload audio selections.

18. A method of providing audience ability to influence the play schedule of a radio station which is determined by an automated radio scheduling system comprising the steps of:

a) gathering audience input electronically by staging a voting event to pick a selection from a plurality of selections;

b) regulating the audience input to select a winning selection; and c) interfacing with the automated radio scheduling system by means of an audience interaction system to automatically affect the scheduling of on-air content so as to incorporate the winning selection into the play schedule of the radio station as a next selection in real time.

19. A method of providing audience interaction with the play schedule of a radio station as set forth in claim 18 further including the step of alerting the audience as to an up-coming voting event.

20. A method of providing audience interaction with the play schedule of a radio station as set forth in claim 19 wherein the step of alerting uses one or more of SMS texting, IM, E-mail, and Social Media, which is cued by the radio station scheduling system.

21. A method of providing audience interaction as set forth in claim 20 with the play schedule of a radio station wherein the audience interaction system further allows the audience to play audio on demand through an audience interactive user interface.

22. A method of providing audience interaction with the play schedule of a radio station as set forth in claim 18 wherein the audience interaction system further allows the audience to upload audio selections.

* * * * *